INDEPENDENTLY REVERSIBLE SEGMENTS AND RANDOM SELECTION MEANS THEREFOR

This invention relates to a segmented assembled 2-sided game apparatus of ambivisual and ambidimensional characteristics, which is highly portable as a multi-part system, and is intended to provide a basic continuous playing basis that can be used in relation to as many game play systems of various forms as can be applied to it.

Just such a game play system is the one described by the specific embodiment of this invention as it is detailed in the following specifications and which might briefly be described as a more or less continuous game of entertainment between 2 people played with cards and patterned after the basic characteristics of traditional TIC-TAC-TOE; more specifically, it is an ambidimensional pocket size portable card game composed of 2 groups of cards, 1 being a 2-sided ambivisually marked and coded Playing Formation consisting of multiple, independently moveable segments, and a second group of 12 playing cards, which are juxtaposed (as illustrated in FIG. 5) on a table or floor, and used in a related and prescribed manner as a process, to create a game of unlimited time length characteristic for entertainment between 2 people, which includes and expands on the basic characteristics of traditional TIC-TAC-TOE and develops these characteristics into new and unique patterns of play.

Other play systems or games applied to this invention would not necessarily take this form or be limited to 2 players as seen in this apecific embodiment of the invention.

The specific embodiment described herein is used only as a typical example of the ambivisual and ambidimensional characteristics of the invention as a multi-part system and will be seen to enclose all of the basic principles of the invention which are further set forth in the claims of this patent specification, but is meant in no way to limit the scope or flexibility of this invention as it stands: which is as a completely new and unique concept in the art of board-type games design.

In this regard, the immediately following description gives a brief general summary of the equipment involved in this particular embodiment of the invention, and is followed by a detailed description of the method and object of play for that embodiment, including cross-references to the prior art, in this case traditional TIC-TAC-TOE, in order to better fulfill the understanding of the unique principles of this invention as compared to the previous art, which is all conventional board games as we know them.

As a notation, the term 'ambivisual' is used repeatedly in the descriptions and discussions of the game apparatus which is the subject of this patent specification and the claims that follow, and it is convenient at this point to hereby disclose a specific definition for that term, which is: to indicate reference to the *multiple visual characteristics* of the 2-sided Playing Formation, whose segments are found to have both the top and bottom sides marked with a complex of visual images, and which are read and played with whatever alternate side happens to be discovered on the visible surface of the Playing Formation.

The equipment for this particular embodiment of the invention consists of 2 groups of cards: 1 group of 9 square cards printed on both sides with synonomous ambivisual markings and numbered 1 thru 9; these markings are color coded and number coded and the cards also have a set of large X's printed on one side and large O's printed on the other; when juxtaposed side by side, they combine to form a 2-sided ambivisually marked larger square, which is designated as the Playing Formation, layout or the like. The second group of cards is made up of 12 regular size playing cards consisting of 9 cards numbered 1 thru 9, and printed on one side to coincide in color and number with the 9 Playing Formation segments mentioned above, as well as 3 'joker' cards, also printed on one side; the 12 cards together are designated as the Draw Pile. Along with these 2 groups of cards, the game's equipment in this particular embodiment also includes an instruction sheet containing the rules and scoring procedures. The 2 groups of cards and the instruction sheet are enclosed in a portable wafer-thin unit or box. Thus the design of the described Playing Formation segments to assemble and dissemble is therefore instrumental in creating a compact unit system that is easily portable and small enough to be carried in the average pocket or purse, thus representing a significant improvement over the bulkiness of traditional games employing a conventional playing board as known in the prior art.

In object this game system may be compared to the old English game of NOUGHTS AND CROSSES, and what we might call 'regular' TIC-TAC-TOE, an American version of the same. However, between NOUGHTS AND CROSSES and this particular version of the invention known as "BLACKOUT TIC-TAC-TOE" there are 2 significantly differing aspects: the old games of traditional TIC-TAC-TOE and NOUGHTS AND CROSSES can be described as 2-dimensional in a physical sense and limited in a time sense, whereas BLACKOUT TIC-TAC-TOE as a specific embodiment of this invention is, by nature of the invention, ambidimensional/ambivisual in a physical sense and unlimited in a time sense. These 2 aspects are essentially interrelated, and will be described both conceptually in respect to the invention in the following summary, as well as in physical detail in regard to the specific embodiment with the aid of the illustrations and the technical disclosure that follows.

NOUGHTS AND CROSSES and what we call 'regular' TIC-TAC-TOE represent the prior art, and by its nature, we find, was limited to a fixed, 2-dimensional surface that could accomodate no more than 9 marks, usually pencilled in by the participating players.

In contrast to this, BLACKOUT TIC-TAC-TOE, as a specific embodiment of the main principles of this invention, is unlimited and continuous in the number of moves and scorings possible to 2 players, due to the 2-sided ambivisual aspect of the Playing Formation, and the consequent length of the said game is only limited by the players' interest, time available to play, or the point limit system the players might chose.

The basic difference between the prior art and the example of the invention as just described is due primarily to (1) the first unique characteristic of this invention which is the ambivisual and ambidimensional aspect of the 2-sided Playing Formation which can be overturned and played continuously with both sides, i.e. rather than playing *on* the assembled multi-card Playing Formation or layout, you play *with* it in a 3-dimensional or ambidimensional manner by overturning it, card by card, over and over again; thus each card or part of the Playing Formation is independent in movement to the rest, and thus a comparatively infinite number of relationships, as well as an infinite number of change patterns, are available between the several cards composing the Playing Formation, specifically because the relationships are continuously dictated by the constantly reshuffling relationship evolving among the 2nd group of cards composing the accompanying Draw Pile, which, in the case of this specific embodiment, happens to number 12.

As will be seen this first characteristic of the invention, when combined with the second primary characteristic of the invention, which is the chance-controlled factor, or in the case of this embodiment of the invention, the 2nd group of 12 cards or Draw Pile, creates in conjunction a cyclic process that eliminates the traditional use of a fixed board, as well as the need for pencil markings and erasures, and replaces it with a continuously changing playing surface that, thru use, constantly recreates itself and thus affords a continuous basis for unlimited play.

These 2 characteristics, combined with a 3rd operative factor included in this specific embodiment of the invention, which we may call the player's free choice motivation, and which is employed in this specific embodiment by the use of the 3 'joker' cards as they appear randomly in the Draw Pile, create a highly fascinating and entertaining number of sequences and changes which basically can be interminably scored as a continuous, more or less unending game of TIC-TAC-TOE between 2 persons.

Thus, what might be called the unlimited time length characteristic is found to be integrally related to the revolutionary concept of the 2-sided ambivisual game apparatus design embodied in this invention.

In addition to this basic process just described a further modification to the traditional game of TIC-TAC-TOE will herein be detailed, as a feature also new to the art. This modification, to be hereinafter known as 'BLACKOUT', may be briefly described relative to this specific embodiment as a complete temporary exhaustion of the playing possibilities and scoring possibilities of the Playing Formation, as accomplished in the process of play by either player, at any point, or number of points, in any game, due to the random reappearance on the visible surface of the Playing Formation of *all* of the synonomous, or equivalent markings found on the Playing Formation segments, in the case of this specific embodiment being all the X's or all the O's.

Therefore, altho based on the traditional old English game of NOUGHTS AND CROSSES, this example of the invention might best be described as a more-or-less continuous game of TIC-TAC-TOE, with modifications, and is played in an ambidimensional manner by combining a 2-sided ambivisual Playing Formation in conjunction with a constantly reshuffling playing card deck which, when drawn singly, continuously dictates coded moves to the Playing Formation to create a continuous aspect of scoring and play for this particular embodiment of the invention.

These specific embodiments of play and it's modifications will also in turn each be described in detail in the following illustrations (FIGS. 5 thru 10) and disclosure.

Thus, in summary, BLACKOUT TIC-TAC-TOE as a specific embodiment of the invention is seen to be a portable pocket size card game of TIC-TAC-TOE with modifications, and can be prolonged to any arbitary time length decided on by the players, due to its ability to take the limited time length characteristic of traditional TIC-TAC-TOE and expand it thru the ambivisual, ambidimensional, 2-sided nature of the Playing Formation and the combined interaction of the 2related card groups into the unlimited time length feature inherent in this invention, and that is only modified and limited by the players' interest, time available to play, or the point limit system they choose.

The foregoing discussion and the detailed descriptions that follow of this specific embodiment of the invention and its characteristics of play are only to be understood as specific illustrations of the main features of this invention but in no way are these terms or descriptions meant to limit the scope of the invention as it is outlined in the claims that follow the technical disclosure.

FIG. 1 and FIG. 2 show a front and back view of the 9 card ambivisual Playing Formation segments, in an assembled state as they occur in this specific form of the invention.

FIG. 3 refers to the playing card deck, which is designated as the Draw Pile, and consists of 9 cards numbered from 1 to 9, and 3 jokers.

FIG. 4 refers to the back design carried by these 12 cards.

FIG. 5 and FIG. 6 refer to a typical embodiment of the basic 2-step procedure by which the 2 groups of cards are related and by which play is initiated and continued, by the 2nd player as well as the 1st.

FIGS. 7 and 8 and FIGS. 9 and 10 refer to 2 further embodiments instrumental in the mechanics of this specific form of the game: FIGS. 7 and 8 illustrate the basic scoring of TIC-TAC-TOE, which has traditionally always consisted of any 3 X's or O's in a row in any direction; vertical, horizontal, or diagonal.

FIGS. 9 and 10 show completion of the modification 'BLACKOUT', i.e. all Playing Formation cards or segments are finally turned to the same suit or synonomous markings, in this case all O's.

FIGS. 5 and 6 refer to the basic 2-step procedure by which play in this specific form of the invention is initiated and continued. It is illustrated in FIGS. 5 and 6 in the following manner:

FIG. 5 shows all Playing Formation segments or cards turned to an 'O', and play is ready to be initiated by the 'X' player, as it is seen that all 12 cards in the Draw Pile are lying face down below the Playing Formation and ready to be drawn.

FIG. 6 shows the 1st step as the 'X' player begins play by drawing the top card 21 from the Draw Pile 22 and places it face up to the right side of the Draw Pile. It is seen that a No. 9 card has been turned, and the 'X' player correspondingly overturns the Playing Formation No. 9 'O' card 23 to an 'X'. Play is continued in the same manner by both players, only being interrupted when either player turns a Draw Pile card number corresponding to a Playing Formation card that he has already overturned, in which case play is relinquished to the opposite player. The 3 joker cards as they appear randomly in the Draw Pile are employed as free choice motivation by the players to pick any available opposingly marked segment visible on the Playing Formation.

FIGS. 7 and 8 refer to a typical scoring of TIC-TAC-TOE, which for this specific embodiment of the invention is described as any 3 cards in a row in any direction: vertical, horizontal, or diagonal, being completed by a player in either X's or O's. It is illustrated by FIGS.

7 and 8 in the following manner:

FIG. 7 shows No. 9 Playing Formation card 24 already turned to an X, to correspond with the No. 9 Draw Pile card 25 which has been turned by the X player and is shown face up in the illustration.

FIG. 8 shows the following step as the X player continues play by turning the next Draw Pile card 26: in this case a No. 3 card 27 is turned and the X player correspondingly overturns the No. 3 Playing Formation O card to an X 28. In doing so, it is seen that the No. 3 X card completes a 3-card row of X's in 2 directions simultaneously (1 vertical and 1 horizontal): they are both scored as TIC-TAC-TOES. This is the basic mechanics of scoring for this specific embodiment, whether it results in a single, double, triple, or quadruple TIC-TAC-TOE.

FIGS. 9 and 10 refer to a typical embodiment of another unique feature of this specific embodiment of the invention, known as the modification claimed as BLACKOUT, and which is described as the complete overturning of *all* 9 Playing Formation segments by either player to visibly reflect his own suit or synonomous markings (X's or O's).

FIG. 9 shows No. 6 Playing Formation card 29 already turned to an O, to correspond with the No. 6 Draw Pile card 30 which has been turned by the O player and is shown face up.

Figure 10:
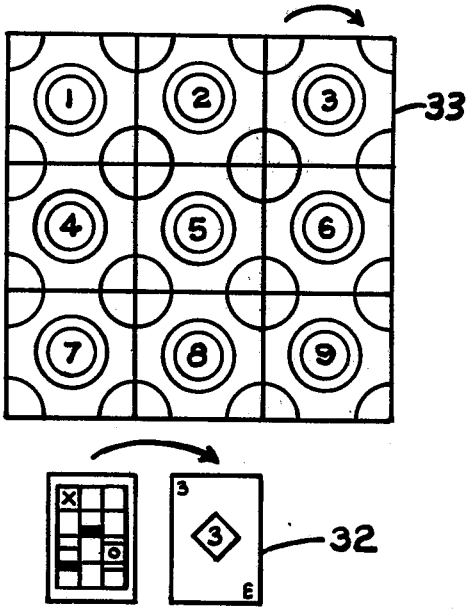

FIG. 10 shows the following step as the O player continues play by turning the next Draw Pile card 31: in this case a No. 3 card 32 is also turned, and the O player correspondingly overturns the No. 3 Playing Formation X card to an O 33. In doing so, it is seen that the No. 3 O card 33 eliminates all X's among the Playing Formation segments thus creating a BLACKOUT for the O player as well as a triple TIC-TAC-TOE. In this specific embodiment, if play is by time limit or a point limit system, and has not been completed, play is resumed by the X player and the game continues. In such cases, BLACKOUT is scored by the preferable rules of this specific embodiment as 5000 points additional to whatever TIC-TAC-TOE points are scored.

Figure 1:
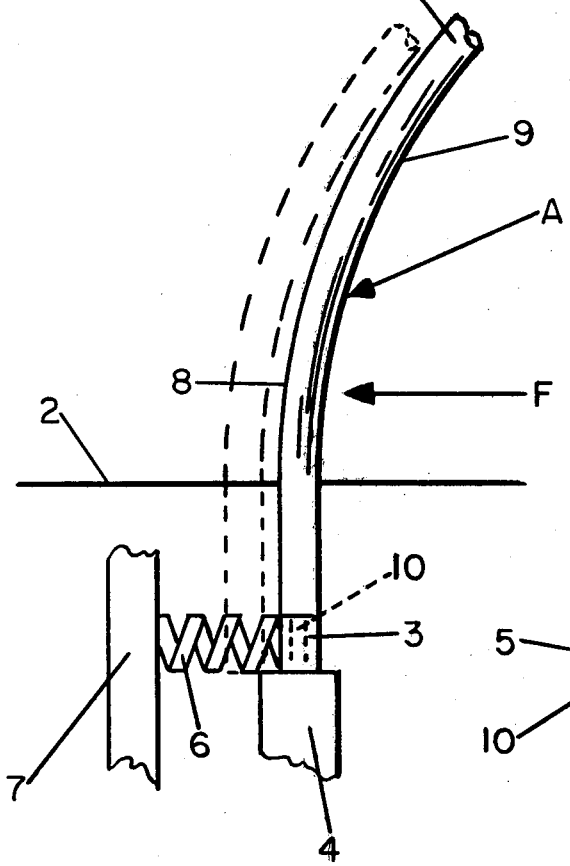
Figure 2:
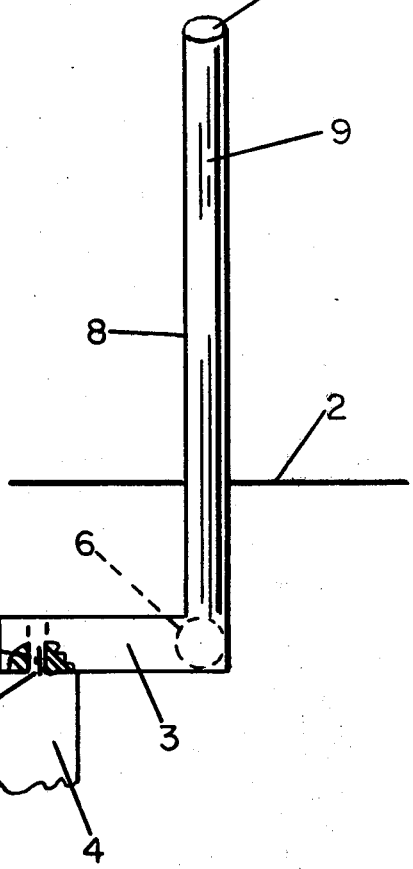
Figure 1:
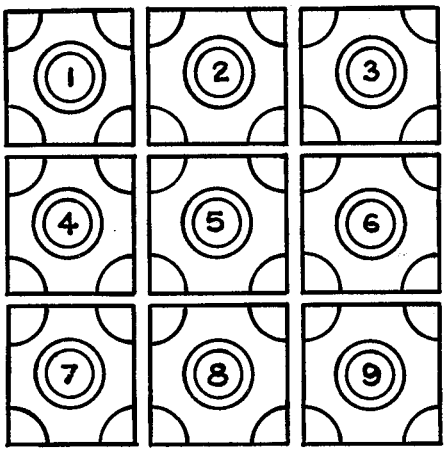
Figure 2:
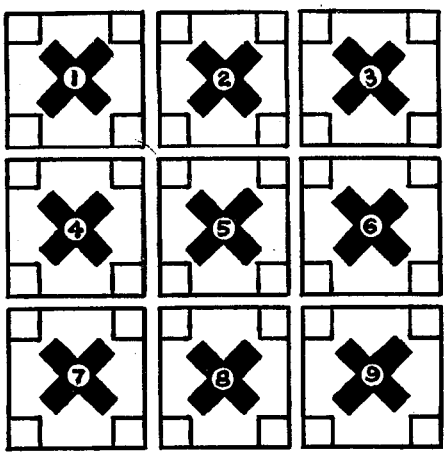
Figure 3:
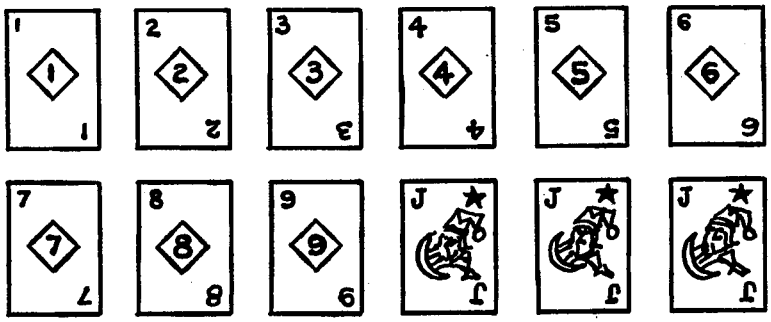
Figure 4:
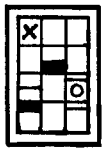
Figure 5:
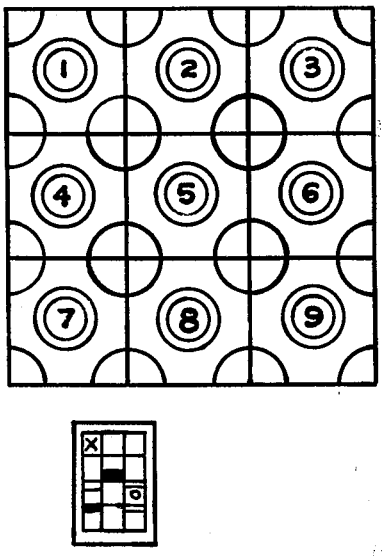
Figure 6:
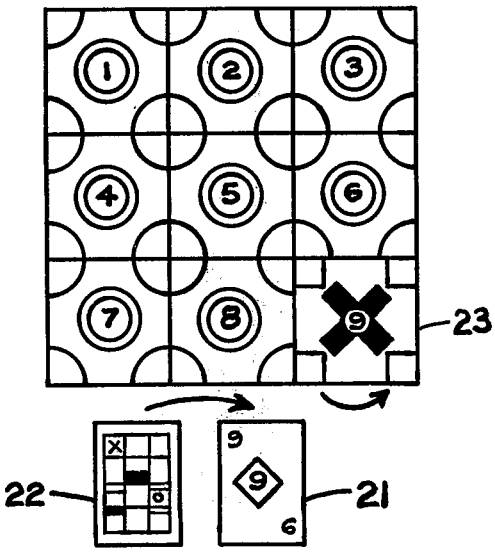
Figure 7:
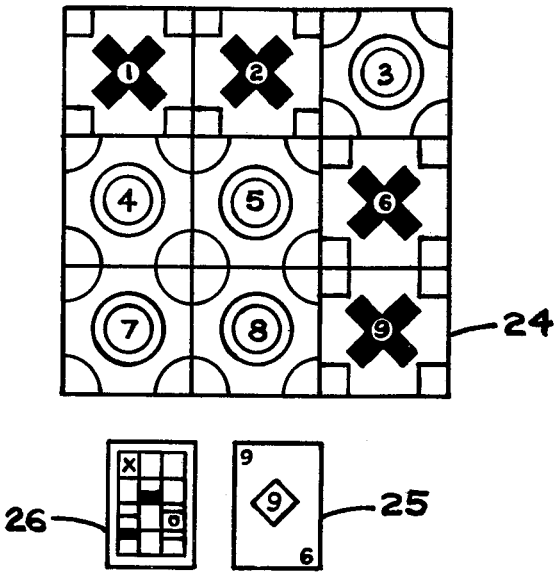
Figure 8:
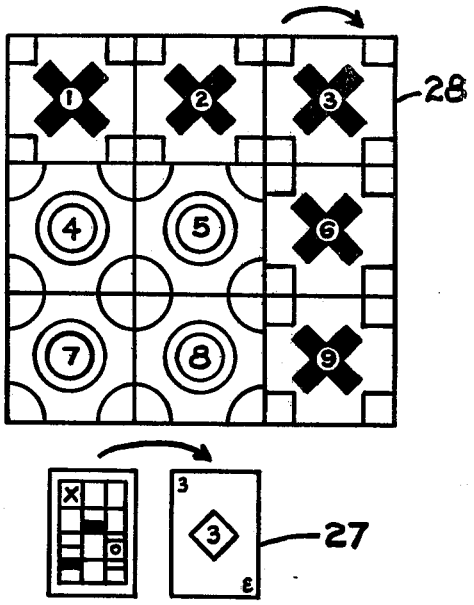
Figure 9:
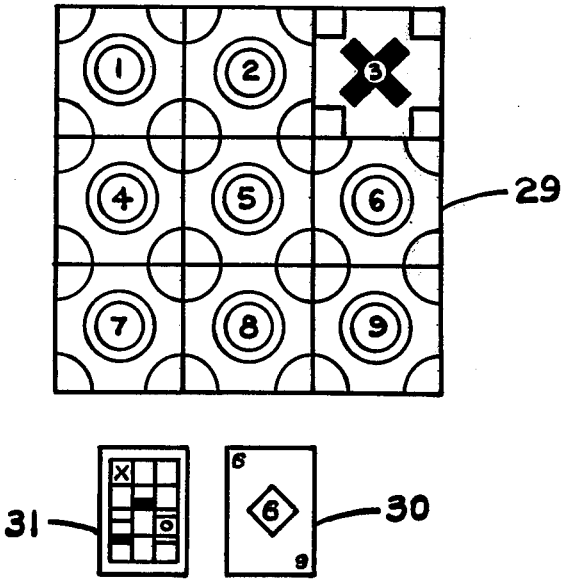
FIGS. 9 and 10 illustrate the mechanics of such a scoring in the following steps.

In order to play the game of this invention, segmented playing pieces are placed as shown in FIG. 1 of the drawings, thus making a playing board. The deck of cards associated therewith are shuffled and then placed face down beside the playing board. This is the draw pile. A coin is flipped to determine who starts play, with the winner of the toss being the X player. The X player starts by drawing a card from the draw pile and then proceeds to turn over the corresponding card of the playing board. This card that has been turned over will now represent an X. The X player will then draw another card from the draw pile and continues to turn the corresponding card over of the playing board until he draws a card from the draw pile which is already turned to an X on the playing board. At that time the X player loses his turn to the other player, which is the O player. The O player then proceeds in the same way in turn. Whenever a player draws a joker card from the draw pile, that player has a free choice of any opposing card on the playing board and to turn that card over.

If a single line of TIC-TAC-TOE results, a certain point value, such as 1,000 points is awarded. If a double TIC-TAC-TOE is resulted of the turning over of any one card of the playing formation, a second scoring value is awarded, such as 2,000 points. If by turning over a single card, a triple TIC-TAC-TOE results, another scoring value is awarded such as 3,000 points. Any one player who turns over all the cards scores what is called a BLACKOUT, which is scored as 5,000 points. When a BLACKOUT is made, the scoring player reshuffles the entire draw pile and replaces it and allows the opposite player to resume play.

This concludes the detailed description of the specific embodiment of the invention. All terms used in the foregoing description of the specific embodiment are only meant to be understood in a generic sense, and not meant in any way to limit the scope of the invention, except as stated in the claims in regard to that specific embodiment. The scope of the invention as well as the claims regarding certain specific embodiments heretofore discussed will now be set forth in the following claims:

What I claim is:

1. A game comprising:

a plurality of like, discrete, and independently reversible playing segments each having substantially planar obverse and reverse faces, said obverse and reverse faces of each of said segments bearing indicia means to at least define a sequential numbering of said segments, said segments being adapted to be placed on a planar supportive surface in a two dimensional polygonal array defining a playing surface;

said indicia means further including on each said obverse side identical first indicia and on each said reverse side identical second indicia distinct from said first indicia, and first and second indicia distinguishing said obverse and reverse sides;

a random selection means including a plurality of different selectible items, a plurality of said items bearing an indicium of number corresponding to said numerical indicia means of a particular said segment, a said item to be randomly selected to initiate reversal of its corresponding said segment.

2. The game as defined in claim 1 wherein:

said random selection means adapted to be constantly recirculated and reapplied to create a continuous dictation of moves to the said reversible segments, and, in thus creating an unlimited play aspect, does result in the random reappearance on the visible surface of the said reversible segments, during the process of play, of all of the said identical first indicia, or all of the said identical second indicia located on said reversible segments.

3. The game as defined in claim 2 wherein:

said random selection means comprises a stack of cards adapted to be drawn one at a time by the players of the game, said stack of cards adapted to be shuffled and placed face down in a stack prior to initiating play of said game, each said segment of said playing surface being numbered to assume a different numerical value from each other said segment and said segments are arranged in numerically sequential order upon said playing surface prior to initiating play of said game, there being at least one said card within said stack of cards for each said numeral of each said segment, whereby the player is to draw the top card from said stack of cards and the numeral located on said card corresponds to a particular said segment, which then to be turned over by the playing player.

4. The game as defined in claim 3 wherein:

the number of said segments being nine, which are arranged in a numerical order of one to nine, said configuration being in the shape of a square.

5. The game as defined in claim 4 wherein:

said first indicia comprises the letter X, said second indicia comprises the letter O.

* * * * *